US005329741A

United States Patent [19]

Nicolaidis et al.

[11] Patent Number: 5,329,741

[45] Date of Patent: Jul. 19, 1994

[54] PORTABLE CONSTRUCTIONAL ELEMENT AND A PROCESS FOR ITS PRODUCTION

[76] Inventors: Raphael Nicolaidis, 29 Parkside Place, Meanwood, Leeds, West Yorkshire, LS6 4NX; Peter S. Hewitt, 16 The Vale, Collingham, Wetherby, West Yorkshire, LS22 5JN, both of United Kingdom

[21] Appl. No.: 40,568

[22] Filed: Mar. 31, 1993

Related U.S. Application Data

[63] Continuation of Ser. No. 722,930, Jun. 28, 1991, abandoned.

[30] Foreign Application Priority Data

Jul. 6, 1990 [GB] United Kingdom ..... 9014990

[51] Int. Cl.[5] ..... E04C 2/00

[52] U.S. Cl. ..... 52/725; 52/612; 52/309.7; 52/309.12; 52/309.17; 52/309.8

[58] Field of Search ..... 52/725, 425, 612, 309.4, 52/309.7, 309.12, 309.17, 309.8, 724

[56] References Cited

U.S. PATENT DOCUMENTS

| | | | |
|---|---|---|---|
| 3,750,355 | 8/1973 | Blum | 52/612 X |
| 3,759,009 | 9/1973 | Ransome | 52/725 X |
| 3,759,009 | 9/1973 | Ransome | 52/725 |
| 3,960,999 | 6/1976 | Massie | 52/309.7 |
| 4,029,037 | 6/1977 | Hogan | 52/309.7 |
| 4,031,285 | 6/1977 | Miller | 428/294 |
| 4,132,043 | 1/1979 | Juba | 52/309.17 |
| 4,232,489 | 11/1980 | Corvington et al. | 52/309.4 |
| 4,304,080 | 12/1981 | Freeman | 52/309.9 |
| 4,441,944 | 4/1984 | Massey | 52/309.17 |
| 4,453,357 | 6/1984 | Zwilgmeyer | 52/309.8 |
| 4,503,677 | 10/1977 | Corao | 52/309.4 |
| 4,774,794 | 10/1988 | Grieb | 52/309.7 |
| 4,936,069 | 6/1990 | Hunter et al. | 52/309.4 |
| 5,249,401 | 10/1993 | Schmid | 52/309.8 |

OTHER PUBLICATIONS

American Concrete Institute, *Lightweight Concrete*, 1971 pp. 147–158.

*Primary Examiner*—Carl D. Friedman
*Assistant Examiner*—Wynn E. Wood
*Attorney, Agent, or Firm*—Joseph S. Iandiorio; Kirk Teska

[57] ABSTRACT

A portable constructional element (4) comprising a foamed cementitious material (8) in an outer plastics covering (10), the foamed cementitious material (8) being such that it has been introduced into the outer covering (10) in a wet state and has set in the outer covering (10) such that the foamed cementitious material (8) is of a substantially uniform character throughout the constructional element, and such that the outer covering (10) forms an integral part of the portable constructional element (4).

9 Claims, 2 Drawing Sheets

PORTABLE CONSTRUCTIONAL ELEMENT AND A PROCESS FOR ITS PRODUCTION

This is a continuation of application Ser. No. 07/722,930, filed Jun. 8, 1991 now abandoned.

This invention relates to a portable constructional element and a process for its production.

Portable constructional elements such for example as lintels, beams, panels, posts, railway sleepers and marine sections are well known. The marine sections include, amongst others, piles, blocks, polypods, beams, panels, laths and pontoons. The portable constructional elements are usually made from solid concrete, metal or wood, or a mixture of these materials. Concrete is heavy and sometimes degrades. Wood tends to decay and is destroyed by fire. Furthermore, the wood does not have the same load bearing properties as concrete. Metal is heavy and tends to erode.

It is an aim of the present invention to provide a portable constructional element which is of a light weight, which is of a good inherent strength, and which will not collapse in the event of a fire.

Accordingly, this invention provides a portable constructional element comprising a foamed cementitious material in an outer covering, the foamed cementitious material being such that it has been introduced into the outer covering in a wet state and has set in the outer covering such that the foamed cementitious material is of a substantially uniform character throughout the constructional element, the outer covering being made of a plastics material, the outer covering having an inner surface which is free of inward deformations acting solely to key the foamed cementitious material no the outer covering, and the outer covering and the foamed cementitious material being secured to one another by the setting of the foamed cementitious material in the outer covering, and the foamed cementitious material being such than it comprises a foaming agent and cement.

The outer covering may be regarded as forming a mould which becomes adhered to the foamed cementitious material. The outer covering will thus normally be in the required shape of the portable constructional element. The portable constructional element may be for use in the construction of any suitable and appropriate structure so that the portable constructional element may find use in the building, construction and civil engineering industries, marine construction, insulation, fire and blast/shock absorption industries, marine and other erosion protection industries, and in land recovery and landscaping industries. The portable constructional element can be in the form of lintels, beams, slabs, panels, posts, railway sleepers, blocks, piles, polypods, tiles and paving slabs. The portable constructional element can be cut to length and/or shape. In the event of a fire destroying the outer covering, the foamed cementitious material will not burn and it will remain in place so that the portable constructional element can be used as a structural element in buildings.

The substantially uniform nature of the foamed cementitious material throughout the portable constructional element enables the portable constructional element to be of a substantially uniform strength. The portable constructional element is one in which the different physical properties of the foamed cementitious material and the outer covering complement each other with the combination giving better strength properties than can be obtained by the foamed cementitious material on its own or the outer covering on its own.

The portable constructional element can be produced in factories or on industrial sites and it can then easily be transported to a construction site. This avoids the need to cast the portable constructional element on s construction site, which may not always be convenient.

The portable constructional element may be one in which the density of the foamed cementitious material is 300–1400 kilograms per cubic meter.

Usually, the outer covering will be closed at at least one end. This will allow the covering to be filled with the foamed cementitious material in its wet state. Preferably, the outer covering is closed at both ends in order to retain the foamed cementitious material in its wet state and to allow the wet foamed cementitious material to set hard.

The or each end of the outer covering may be closed by an end cap or any other desired and suitable means. The or each end may be closed by tying, gluing, wedging, or ultrasonic welding or other welding. Other means for closing the or each end of the outer covering may be employed.

The foamed cementitious material may be a mixture of a liquid foaming agent, air, cement, water and an aggregate, dust or filler material. The precise ingredients for the foamed cementitious material may be varied as may be desired and appropriate. The aggregate may be a natural aggregate, or an artificial aggregate, for example small polystyrene pieces. Liquid foaming agents are well known in fire fighting and in other industries. A preferred liquid foaming agent is a protein based liquid foaming agent. Such a protein based liquid foaming agent may sustain the integrity of the foam for a longer period than a synthetic based liquid foaming agent. The liquid foaming agent preferably includes an anti-freezing additive which helps the foam to survive at temperatures well below freezing.

The foamed cementitious material may be reinforced by a reinforcing material.

Any suitable and appropriate type of reinforcing material may be employed. Thus, for example, the reinforcing material may be s plastics material, a rubber material or a metal. The reinforcing material may be in the form of synthetic fibres, plastics strips, a mesh or rods. The mesh or rods may be made from a plastics material or a metal.

The outer covering may form a solid walled outer covering, or it may form a woven outer covering. Any suitable and appropriate type of plastics material may be employed. Where the outer covering is to form a solid walled outer covering, then the plastics material may be, for example, polyvinyl chloride. Where the outer covering is to be in the form of a woven outer covering, then the plastics material may be in the form of polypropylene fibres.

The present invention also provides a process for the production of a portable constructional element, which process comprises providing an outer covering which is made of a plastics material, filling the outer covering with foamed cementitious material in a wet state, and allowing the wet foamed cementitious material to set such that the foamed cementitious material is of a substantially uniform character throughout the constructional element, and the outer covering being such that it has an inner surface which is free of inward deformations acting solely to key the foamed cementitious material to the outer covering whereby the outer covering and the foamed cementitious material are secured to one another by the setting of the foamed cementitious material in the outer covering, and the foamed cementitious material being such that it comprises a foaming agent and cement.

The portable constructional element will usually be constructed as a pre-cast factory made product.

The process may be one in which the outer covering is provided with a closed end prior to filling with the foamed cementitious material in the wet state.

The process of the invention may be one in which the outer covering is closed at its other end after filling with the foamed cementitious material in the wet state and before the setting.

The process of the invention may include cutting the formed portable constructional element to length and/or shape.

The process of the invention may include providing a reinforcing material in the foamed cementitious material.

The reinforcing material may be provided in the wet foamed cementitious material after it has been introduced into the outer covering. Alternatively, the reinforcing material may be provided in the outer covering prior to the introduction of the wet foamed cementitious material.

In the process of the invention, the above specified specific materials for the constructional elements of the invention may be employed.

Embodiments of the invention will now be described solely by way of example and with reference to the accompanying drawings in which.

Figure 1:
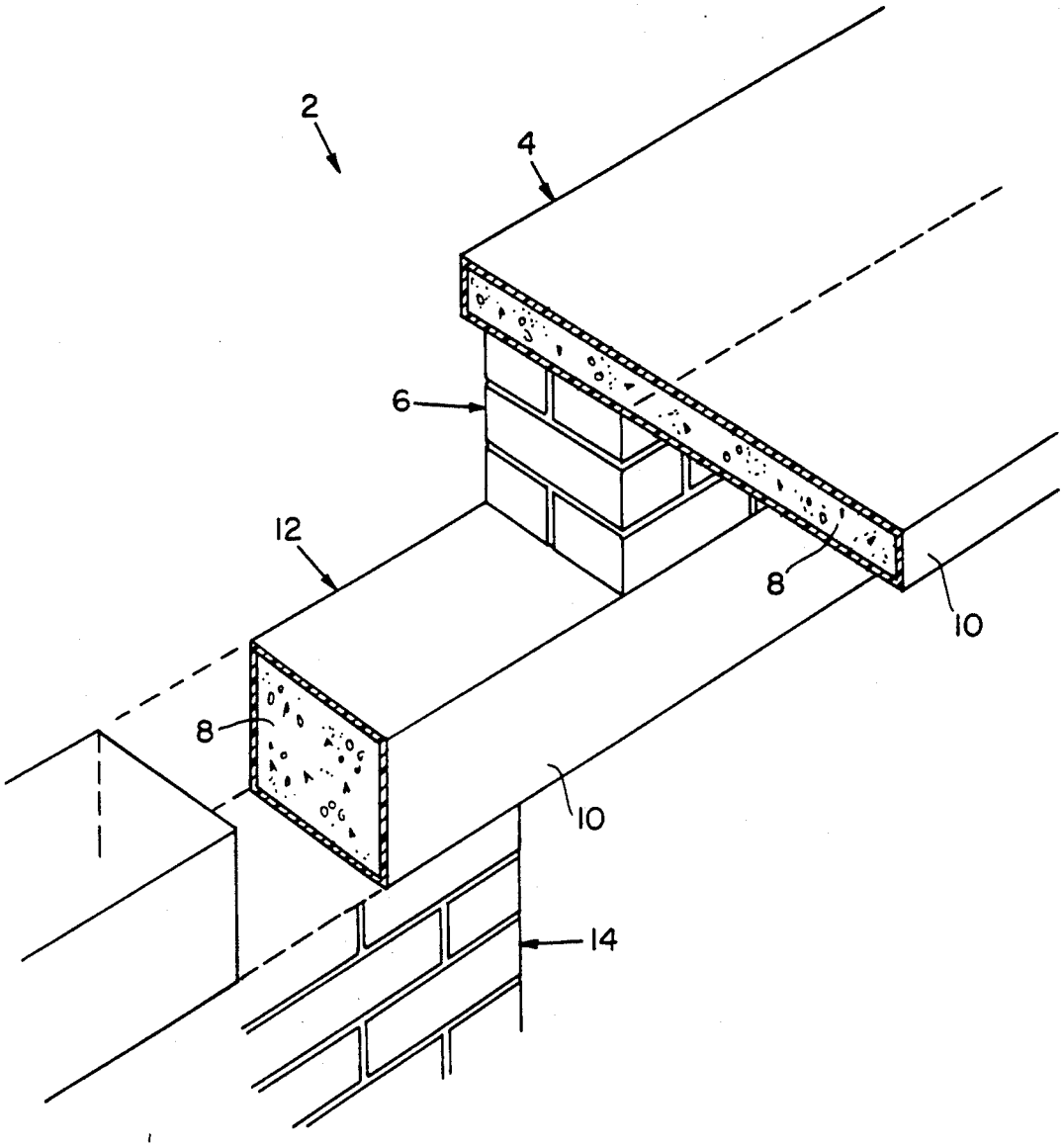
FIG. 1 shows part of a building structure containing two different types of portable constructional elements.

Referring to FIG. 1, there is shown a building structure 2 comprising a portable constructional element in the form of a piece of coping 4 mounted on brickwork 6. The coping 4 comprises a central body portion formed of a foamed cementitious material 8. The foamed cementitious material 8 is located in an outer covering 10. The foamed cementitious material is such that it has been introduced into the outer covering 10 in a wet state and has been set in the outer covering 10. As can be seen from FIG. 1, the outer covering 10 has acted as a mould and it has the same general shape as the set foamed cementitious material 8.

The brickwork 6 is mounted on a portable constructional element in the form of a lintel 12. The lintel 12 is again formed of foamed cementitious material 8 and the outer covering 10. The lintel 12 is mounted on brickwork 14. The lintel 12 has been formed in the same manner as the coping 4.

The outer covering 10 of both the coping 4 and the lintel 12 is in the form of a solid walled plastics material. The plastics material is effective to contain the foamed cementitious material 8 whilst it is in a wet state and is setting. During production of the coping 4 and the lintel 12, one end of the outer covering 10 will be sealed to enable the outer covering 10 to hold the foamed cementitious material 8 whilst the foamed cementitious material 8 is setting from a wet to a hard state. Once the wet foamed cementitious material 8 has been introduced into the outer covering 10, then the other end of the outer covering 10 can also be closed. The ends of the outer covering 10 will usually be closed by cap members (not shown) but any suitable and appropriate means of closing the ends of the outer covering 10 can be employed.

As will be appreciated from FIG. 1, in the event of a fire, with the outer covering 10 being made of a plastics material, this material could burn. However, the foamed cementitious material 8 will remain in position so that the building structure will not collapse. In addition, the outer covering 10 can be treated with a fire retardant material. Thus the coping 4 and the lintel 12 are strong, lightweight and ideally suited for use in forming parts of buildings.

Figure 2:
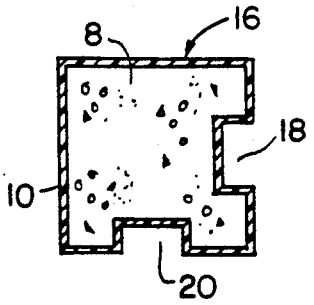
FIG. 2 is a cross section through a corner fencing post.

FIG. 2 shows a fencing post 16 having foamed cementitious material 8 and an outer covering 10. The fencing post 16 shown in FIG. 2 is a corner fencing post and it has two grooves 18, 20 for receiving the edges of panels.

Figure 3:
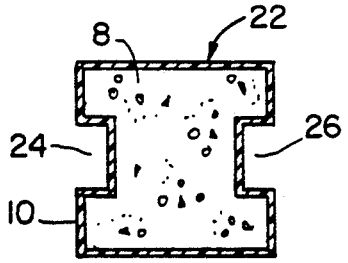
FIG. 3 is a cross section through a mid fencing post.

FIG. 3 shows a fencing post 22. The fencing post 22 is a mid fencing post and therefore it has two grooves 24, 26 which are opposed to each other. The fencing post 22 is again formed of the foamed cementitious material 8 and the outer covering 10.

Figure 4:
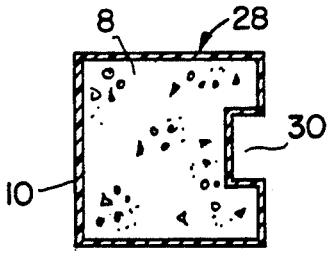
FIG. 4 is a cross section through an end fencing post.

FIG. 4 shows a fencing post 28 which is an end fencing post and which therefore only has one groove 30. The fencing post 28 is again formed of the foamed cementitious material 8 and the outer covering 10.

Figure 5:
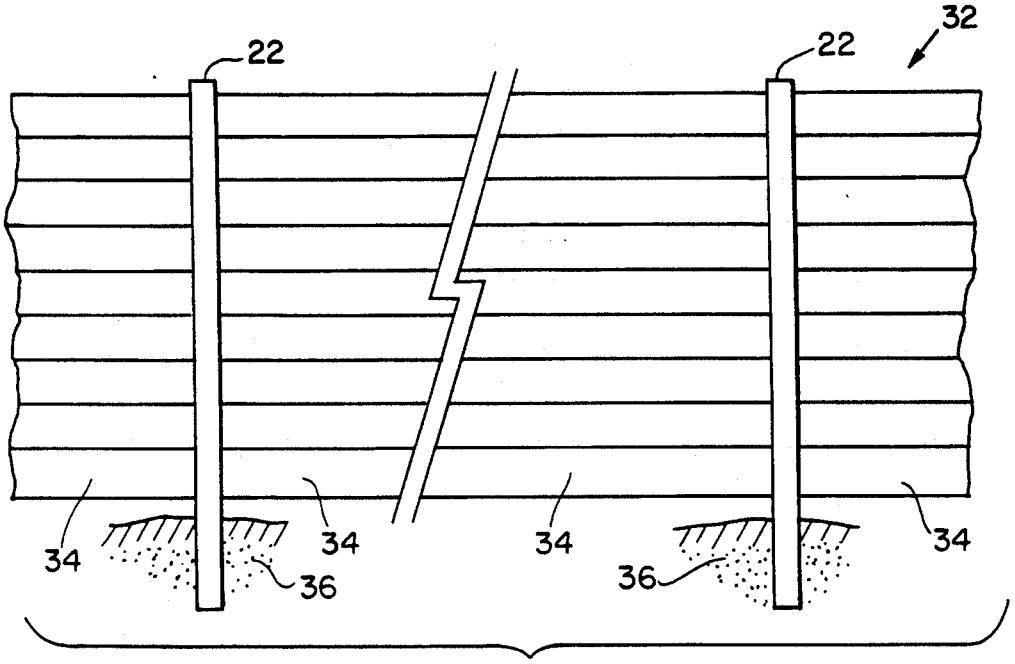
FIG. 5 shows two of the posts shown in FIG. 3 in use and forming part of a fence.

FIG. 5 shows two of the mid fencing posts 22 used in a fence 32 and supporting fence panels 34. The fencing posts 22 can be cut to length and secured in the ground 36.

Figure 6:
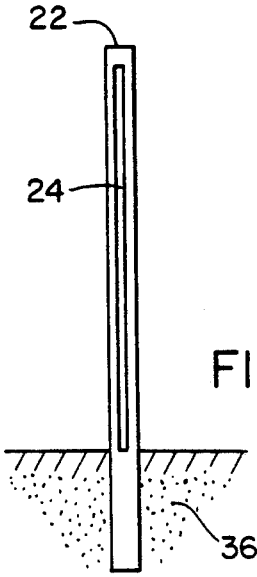
FIG. 6 illustrates one side of the post shown in FIG. 3.

FIG. 6 is a side view of the fencing post 22 and shows the groove 24.

Figure 7:
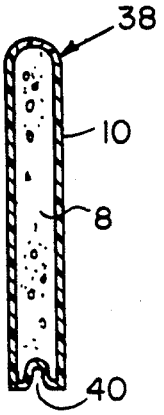
FIG. 7 shows a portable constructional element in the form of a panel.

FIG. 7 is a section through a panel 38. The panel 38 can be used as any desired constructional element. The panel 38 has a groove 40 as shown. The panel 38 is made from the foamed cementitious material 8 and the outer covering 10. In FIG. 7, the outer covering 10 is preferably made from polyvinyl chloride, and the foamed cementitious material may be regarded as foamed concrete.

The constructional elements of the present invention such as the coping 4, the lintel 12 and the fencing posts 16, 22 and 28 can easily be produced to be pre-formed ready for use. As mentioned above, they are of good physical strength, of lightweight construction and of good durability. They can be produced without the need for large manufacturing plant or large manufacturing space. They can be produced in a cost effective manner.

The density of the foamed cementitious material can vary according to the strength required. In addition, if desired, the foamed cementitious material can be reinforced by the addition of reinforcing material such for example as synthetic fibres, plastics strips or mesh.

When the foamed cementitious material has cured, it provides the required rigidity and strength for enabling the finished constructional element to meet the desired load demands. The foamed cementitious material may also provide insulating properties. When set hard, the foamed cementitious material can be cut or drilled without damage to the surfaces exposed.

As indicated above, for example the outer covering 10, can be formed in any geometrical and dimensional configuration. Preferably, the outer covering is rigid or substantially rigid so that the wet foamed cementitious material does not unduly deform the outer covering. Alternatively, if the outer covering is deformable, then it can be retained in a retaining mould. Where the outer covering is made of a plastics material, then the plastics material may be treated so that it does not substantially degrade under the effect of ultra-violet rays.

As indicated above, the outer covering may be sealed at both ends. This tends to facilitate storage during the time taken for the curing of the foamed cementitious material. If shrinkage should take place, then the outer covering 10 can be re-opened, and filled or cut.

The outer covering may be made of different colours and the surface may be of differing textures. Thus, for example the surface of the outer covering may be smooth, grained, patterned or of a convex or concave impression.

The outer covering may generally be substantially maintenance free. It may be washed if desired. Because the outer covering is made of a plastics material, it will generally not be affected by weathering or by the growth of organisms.

If desired, the outer covering may be sprayed or otherwise externally provided with the cementitious material to add to the fire resistant benefits of the foamed cementitious material within the mould.

If desired, all load bearing surfaces may be plastic, as well as those requiring protection from wear and tear. Non-load bearing surfaces may or may not be plastic and they may or may not be exposed.

The reinforcing material may include or consist of rubber or synthetic chips from used tires, including any steel or other strengthening contained therein.

The use of fully sealed outer casings/moulds allows partly cured constructional elements to be moved and stored, reducing the area required for production. The foamed cementitious material may be called lightweight cellular concrete. The foamed cementitious material can be formed by a number of different blending techniques, the cost of which varies according to the production quantities desired.

The formed constructional elements of the present invention can be up to 80% lighter in weight than existing pre-cast constructional elements of the same size. Lower transport costs may be achievable since a greater number of elements may be transported on a vehicle before it reaches its maximum weight. Lower production investment benefits may be achieved due to a lower prime material cost. The introduction of foam reduces the amount of natural resources used in producing load bearing elements equivalent to those using traditional materials. Where used tires and other off-cut synthetic waste is used as reinforcing means, there is a recovery of otherwise waste resources. The set foamed cementitious material is of a substantially uniform character throughout the constructional element, and it is such that the outer covering forms an integral part of the portable constructional element.

It is to be appreciated that the embodiments of the invention described above with reference to the accompanying drawings have been given by way of example only and that modifications may be effected. Thus, for example, portable constructional elements of different shapes and purposes to those illustrated in the drawings may be produced. If desired, sheet protective material such as KEVLAR (trade mark) can be sandwiched between two portable constructional elements of the present invention to produce a product which is of use in defence and security applications. For example, the product can be shock resistant and it can be used in buildings and vehicles. If the portable constructional element is sandwiched between two pieces of metal, plastics or other material, an insulating product can be produced insulating against extremes of heat and cold.

We claim:

1. A portable constructional element comprising a foamed cementitious material in an outer covering, the foamed cementitious material being such that it has been introduced into the outer covering in a wet state and has set in the outer covering such that the foamed cementitious material is of a substantially uniform character throughout the constructional element, the outer covering being made of a plastics material, the outer covering having an inner surface which is free of inward deformations acting solely to key the foamed cementitious material to the outer covering, the outer covering and the foamed cementitious material being secured to one another by the setting of the foamed cementitious material in the outer covering, and the foamed cementitious material being such that it comprises a foaming agent and cement.

2. A portable constructional element according to claim 1 in which the density of the foamed cementitious material is 300–1400 kilograms per cubic meter.

3. A portable constructional element according to claim 1 in which the outer covering is closed at at least one end.

4. A portable constructional element according to claim 1 in which the foamed cementitious material is reinforced by a reinforcing material.

5. A process for the production of a portable constructional element, which process comprises providing an outer covering which is made of a plastics material, filling the outer covering with foamed cementitious material in a wet state, allowing the wet foamed cementitious material to set such that the foamed cementitious material is of a substantially uniform character throughout the constructional element, the outer covering being such that it has an inner surface which is free of inward deformations acting solely to key the foamed cementitious material to the outer covering whereby the outer covering and the foamed cementitious material are secured to one another by the setting of the foamed cementitious material in the outer covering, and the foamed cementitious material being such that it comprises a foaming agent and cement.

6. A process according to claim 5 in which the density of the foamed cementitious material is 300–1400 kilograms per cubic meter.

7. A process according to claim 5 in which the outer covering is provided with a closed end prior to filling with the foamed cementitious material in the wet state, and in which the outer covering is closed at its other end after filling with the foamed cementitious material in the wet state and before the setting.

8. A process according to claim 7 and including cutting the formed portable constructional element to at least one of length and shape.

9. A process according to claim 5 and including providing a reinforcing material in the foamed cementitious material.

* * * * *